US010544713B2

(12) United States Patent
Sadakane et al.

(10) Patent No.: US 10,544,713 B2
(45) Date of Patent: Jan. 28, 2020

(54) CONTROL DEVICE FOR INTERNAL COMBUSTION ENGINE

(71) Applicant: TOYOTA JIDOSHA KABUSHIKI KAISHA, Toyota-shi, Aichi-ken (JP)

(72) Inventors: Shinji Sadakane, Susono (JP); Hiroyuki Sugihara, Suntou-gun (JP); Noriyasu Adachi, Numazu (JP); Keisuke Sasaki, Susono (JP); Shigehiro Sugihira, Susono (JP); Takayoshi Kawai, Susono (JP); Kaoru Ohtsuka, Mishima (JP)

(73) Assignee: Toyota Jidosha Kabushiki Kaisha, Toyota-shi, Aichi-ken (JP)

( * ) Notice: Subject to any disclaimer, the term of this patent is extended or adjusted under 35 U.S.C. 154(b) by 0 days.

(21) Appl. No.: 15/936,096

(22) Filed: Mar. 26, 2018

(65) Prior Publication Data

US 2018/0283225 A1 Oct. 4, 2018

(30) Foreign Application Priority Data

Mar. 31, 2017 (JP) ..... 2017-071725

(51) Int. Cl.
*F01L 13/00* (2006.01)
*F01L 1/26* (2006.01)

(52) U.S. Cl.
CPC ..... *F01L 1/267* (2013.01); *F01L 13/0036* (2013.01); *F01L 2013/0052* (2013.01); *F01L 2201/00* (2013.01); *F01L 2800/11* (2013.01); *F01L 2820/044* (2013.01)

(58) Field of Classification Search
CPC ..... F01L 2001/0473; F01L 1/053; F01L 2013/0052; F01L 2800/11; F01L 2800/12
USPC ..... 123/90.18, 90.27
See application file for complete search history.

(56) References Cited

U.S. PATENT DOCUMENTS

| | | | | |
|---|---|---|---|---|
| 3,638,624 | A * | 2/1972 | O'Grady | F01L 13/0036 123/90.18 |
| 2002/0088416 | A1* | 7/2002 | Nakamura | F02D 41/221 123/90.16 |
| 2012/0222635 | A1 | 9/2012 | Sunada et al. | |
| 2015/0330270 | A1* | 11/2015 | Noda | F01L 1/08 123/90.2 |

(Continued)

FOREIGN PATENT DOCUMENTS

| | | | |
|---|---|---|---|
| DE | 10 2012 006 820 | A1 | 10/2013 |
| JP | H-01-110817 | A | 4/1989 |
| JP | H-0463922 | A | 2/1992 |

(Continued)

*Primary Examiner* — Jorge L Leon, Jr.
(74) *Attorney, Agent, or Firm* — Finnegan, Henderson, Farabow, Garrett & Dunner, LLP

(57) ABSTRACT

A control device is configured, if, although the control device has caused a cam switching device to perform a first cam switching operation for switching the profiles of all the valve-driving cams of a plurality of cylinders from a first profile to a second profile, the profiles of all the valve-driving cams of the plurality of cylinders do not coincide with the second profile, to cause the cam switching device to perform a second cam switching operation for switching the profile of the valve-driving cam for at least one or more normal cylinders that are one or more cylinders at which the switching of profiles to the second profile has succeeded.

4 Claims, 9 Drawing Sheets

(56) References Cited

U.S. PATENT DOCUMENTS

2016/0194984 A1* 7/2016 Haga ..... F02D 41/221
123/90.16

FOREIGN PATENT DOCUMENTS

| | | | |
|---|---|---|---|
| JP | 2000-018057 | A | 1/2000 |
| JP | 2013-151911 | A | 8/2013 |
| JP | 2014-015867 | A | 1/2014 |
| JP | 2015-34534 | | 2/2015 |
| WO | WO 2011/064852 | A1 | 6/2011 |

* cited by examiner

CONTROL DEVICE FOR INTERNAL COMBUSTION ENGINE

CROSS-REFERENCE TO RELATED APPLICATION

This application is based on and claims the benefit of Japanese Patent Application No. 2017-071725, filed on Mar. 31, 2017, which is incorporated by reference herein in its entirety.

BACKGROUND

Technical Field

The present disclosure relates to a control device for an internal combustion engine, and more particularly to a control device for controlling an internal combustion engine that includes a cam switching device that is capable of switching a cam that drives an intake valve or an exhaust valve that opens and closes a combustion chamber.

Background Art

For example, JP 2013-151911 A discloses an internal combustion engine that includes a variable operating angle device that makes variable an operating angle of an intake valve. This variable operating angle device is configured to switch, between a small operating angle cam and a large operating angle cam, a cam for opening and closing the intake valve.

In addition to JP 2013-151911 A, JP 2015-034534 A and DE 102012006820 A1 are patent documents which may be related to the present disclosure.

SUMMARY

An internal combustion engine is known that includes a plurality of cylinders and that is capable of selectively switching, between a plurality of cam profiles, a profile of a valve-driving cam that drives a valve (intake valve or exhaust valve) that opens and closes a combustion chamber on a cylinder basis or a cylinder group basis. In this kind of internal combustion engine, if the switching of the profiles fails for some of the cylinders or for some groups of the cylinders, the profiles of the valve-driving cam become different between cylinders or between cylinder groups. As a result, there is a concern that the drivability or exhaust emission performance of the internal combustion engine may be deteriorated.

A control device according to an embodiment of this disclosure may be provided for an internal combustion engine, wherein the control device decreases the chance of having different valve-driving cam profiles between cylinders or between groups of cylinders following a cam switching operation that switches profiles of valve-driving cams of a plurality of cylinders. The control device can decrease the probability that the profiles of the valve-driving cams end up different between cylinders or between cylinder groups even if the switching of the profiles fails for some of the cylinders or for some of the cylinder groups.

A control device for controlling an internal combustion engine according to the present disclosure is configured to control an internal combustion engine that includes:

a plurality of cylinders;

a camshaft;

a plurality of cams which are attached to the camshaft and arranged for each of the plurality of cylinders, wherein profiles of the plurality of cams for each cylinder are different from each other; and a cam switching device configured to switch, between the profiles of the plurality of cams, a profile of a valve-driving cam that is a cam that drives a valve that opens and closes a combustion chamber in each of the plurality of cylinders on a cylinder basis or a cylinder group basis.

A control device according to this disclosure may cause the cam switching device to perform a first cam switching operation for switching the profile of the valve-driving cam of each of the plurality of cylinders from a first profile to a second profile. However, in some situations the profiles of one or more of the valve-driving cams of the plurality of cylinders following such a cam switching operation may not coincide with the second profile. In these situations, the control device according to embodiments of this disclosure may be configured to cause the cam switching device to perform a second cam switching operation for switching the profile of the valve-driving cam back to the first profile for one or more normal cylinders at which the first cam switching operation for switching the profiles to the second profile has succeeded. The control device according to embodiments of this disclosure may also be configured to cause the cam switching device to perform a second cam switching operation for switching the profile of the valve-driving cam back to the first profile for one or more cylinders at which the first cam switching operation for switching the profiles to the second profile has not succeeded. The second cam switching operation switches the profile of one or more cylinders after the first cam switching operation back to the first profile.

When the profiles of one or more of the valve-driving cams of the plurality of cylinders do not coincide with the second profile during an increase of engine speed following performance by the control device of the first cam switching operation, the control device may be configured to perform the second cam switching operation for one or more cylinders. The one or more cylinders at which the second cam switching operation is performed may be one or more normal cylinders at which the first cam switching operation has succeeded, or one or more cylinders at which the first cam switching operation has not succeeded.

When the profiles of one or more of the valve-driving cams of the plurality of cylinders do not coincide with the second profile during an increase of the engine speed following performance by the control device of the first cam switching operation, the control device may be configured to determine whether or not a time margin for retry remains before the engine speed reaches a switching upper limit value. The switching upper limit value of engine speed is the top engine speed at which the profiles of the valve-driving cams can be switched. The time margin for retry is a sum of a time required to retry the first cam switching operation and a time required to perform the second cam switching operation if the retry of the first cam switching operation has failed. The control device may be configured to cause the cam switching device to retry the first cam switching operation if the time margin for retry remains. If the time margin for retry does not remain, the control device may be configured to cause the cam switching device to perform the second cam switching operation.

The switching upper limit value of the engine speed may be relatively smaller when a temperature of an oil that lubricates the plurality of cams arranged in each of the plurality of cylinders is relatively lower, as compared to a relatively higher switching upper limit value of the engine speed when the temperature of the oil is relatively higher.

When the number of times in which the profiles of one or more of the valve-driving cams of the plurality of cylinders do not coincide with the second profile following performance of the first cam switching operation has exceeded a threshold value, the control device may be configured to actuate a malfunction indicator device to notify a driver of a vehicle on which the internal combustion engine is mounted of a malfunction concerning the cam switching device.

The cam switching device may include:

a cam groove which is provided on an outer periphery surface of the camshaft; and an actuator which is equipped with an engagement pin engageable with the cam groove, and which is configured to protrude the engagement pin toward the camshaft.

The cam switching device may be configured such that, when the engagement pin is engaged with the cam groove, the valve-driving cam is switched between the plurality of cams in association with a rotation of the camshaft.

When the profiles of one or more of the valve-driving cams of the plurality of cylinders do not coincide with the second profile following performance of the first cam switching operation, the second cam switching operation is performed. When the switching of the profiles of the valve-driving cams to the second cam profile by the first cam switching operation is retried for one or more cylinders at which a failure of the switching to the second profile has occurred, the switching to the second profile may fail again due to the effect of a malfunction that causes the failure during the first attempt. Thus, the probability that the second cam switching operation for returning the profiles of the valve-driving cams to the first profile succeeds at one or more cylinders at which the switching to the second profile by the first cam switching operation can be successfully performed is higher than the probability that the first cam switching operation for retrying the switching of the profiles of the valve-driving cams to the second profile succeeds at one or more cylinders at which the switching to the second profile by the first cam switching operation has failed. Therefore, the control device of the present disclosure may decrease the probability that the profiles of the valve-driving cams end up different between cylinders or between cylinder groups, even if the switching of the profiles has failed for some of the cylinders or for some of the cylinder groups when the cam switching operation for switching the profiles of the valve-driving cams of the plurality of cylinders is performed.

DETAILED DESCRIPTION

In the following, embodiments of the present disclosure are described with reference to the accompanying drawings. However, it is to be understood that even when the number, quantity, amount, range or other numerical attribute of an element is mentioned in the following description of the embodiments, the present disclosure is not limited to the mentioned numerical attribute unless explicitly described otherwise, or unless the present disclosure is explicitly specified by the numerical attribute theoretically. Further, structures or steps or the like that are described in conjunction with the following embodiments are not necessarily essential to the present disclosure unless explicitly shown otherwise, or unless the present disclosure is explicitly specified by the structures, steps or the like theoretically.

First Embodiment

First, a first embodiment according to the present disclosure will be described with reference to FIGS. 1 to 6.

1. Configuration of System According to First Embodiment

An internal combustion engine 1 of a system according to an embodiment of this disclosure is mounted in a vehicle, and is used as a power source thereof. The internal combustion engine 1 may be a four-stroke in-line four-cylinder engine, as an example. The firing order of an exemplary internal combustion engine 1 may be a first cylinder #1 to a third cylinder #3, to a fourth cylinder #4 and to a second cylinder #2, as an example.

Figure 1:
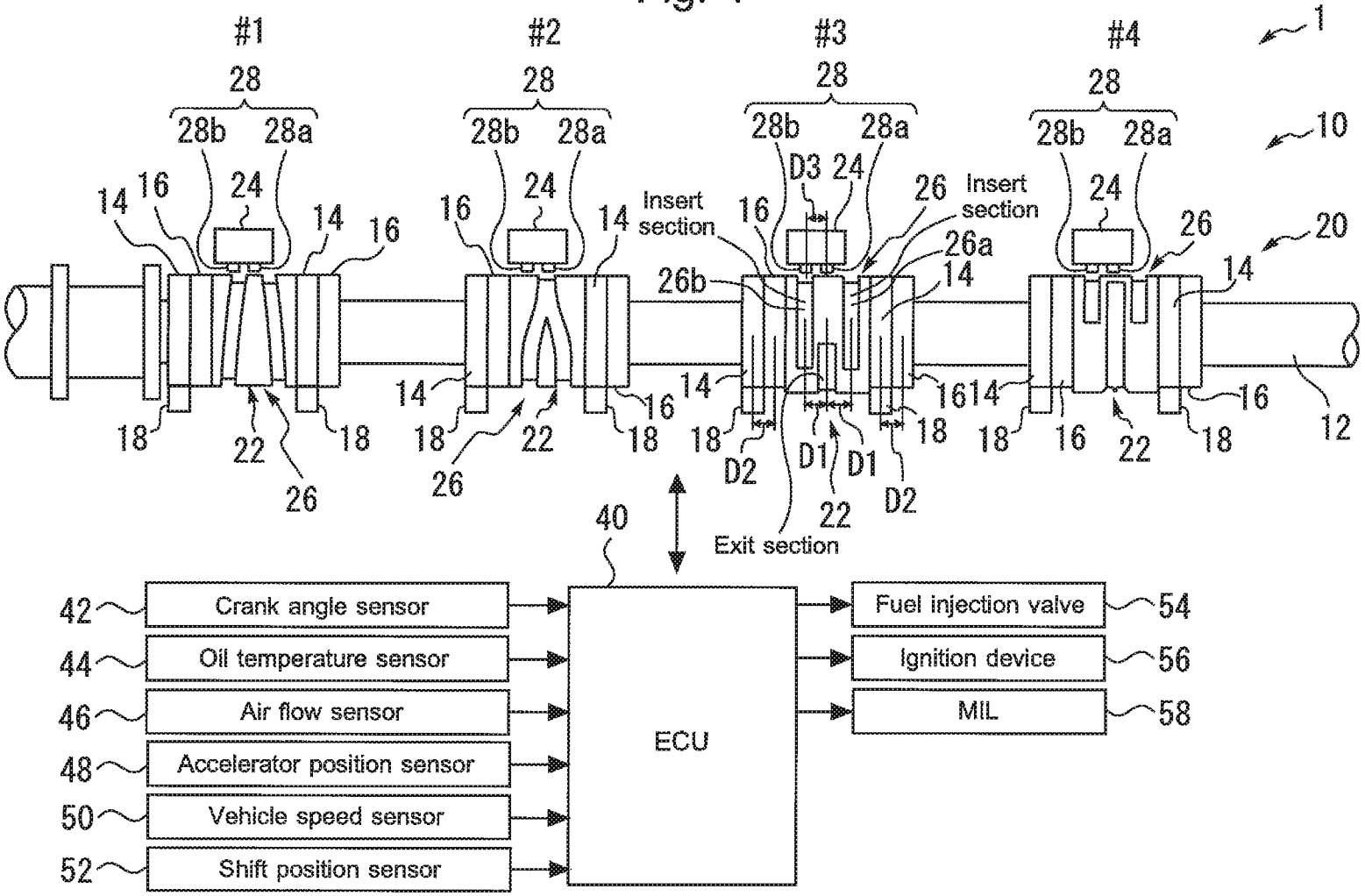
FIG. 1 is a diagram that schematically illustrates a configuration of a main part of a valve train of an internal combustion engine according to a first embodiment of the present disclosure.

FIG. 1 is a diagram that schematically illustrates a configuration of a main part of a valve train of the internal combustion engine 1 according to the first embodiment of the present disclosure. In the internal combustion engine 1, two intake valves (not shown in the drawing) are provided for each cylinder, as an example. Moreover, the internal combustion engine 1 is provided with a variable valve operating device 10 for driving these two intake valves. In addition, the variable valve operating device 10 described below is applicable to a valve that opens and closes a combustion chamber, and thus, it may be used to drive an exhaust valve, instead of the intake valve.

1-1. Camshaft

The variable valve operating device 10 is equipped with a camshaft 12 for driving the intake valves for each cylinder. The camshaft 12 is connected to a crankshaft (not shown in the drawing) via a timing pulley and a timing chain (or a timing belt) which are not illustrated, and is driven to rotate at half of the speed of the crankshaft by the torque of the crankshaft.

1-2. Intake Cam

The variable valve operating device 10 is equipped with a plurality of (as an example, two) intake cams 14 and 16 whose profiles are different from each other and which are provided for the respective intake valves in each cylinder. The intake cams 14 and 16 are attached to the camshaft 12 in a manner described later. The profile of the intake cam 14 is set such that the intake cam 14 serves as a "small cam" for obtaining, as the lift amount and the operating angle (i.e., the crank angle width in which the intake valve is open) of the intake valve, a lift amount and an operating angle that are relatively smaller. The profile of the remaining intake cam 16 is set such that the intake cam 16 serves as a "large cam" for obtaining a lift amount and an operating angle that are greater than the lift amount and the operating angle obtained by the intake cam 14. It should be noted that one of the profiles of the plurality of intake cams may have only a base circle section in which the distance from the axis of the camshaft 12 is constant. That is, one of the intake cams may also be set as a zero lift cam which does not give a pressing force to the intake valve.

A rocker arm 18 for transmitting a pressing force from the intake cam 14 or 16 to the intake valve is provided for each of the intake valves. FIG. 1 shows an operating state in which the intake valves are driven by the intake cams (small cams) 14. Thus, in this operating state, each of the intake cams 14 is in contact with the corresponding rocker arm 18 (more specifically, a roller of the rocker arm 18).

1-3. Cam Switching Device

The variable valve operating device 10 is further equipped with a cam switching device 20. The cam switching device 20 performs a cam switching operation by which a profile of a "valve-driving cam" that is the cam that drives the intake valve (in other words, the cam that is to be mechanically connected to the intake valve) is switched between profiles of the intake cams 14 and 16. The cam switching device 20 is equipped with a cam carrier 22 and an actuator 24 for each cylinder.

The cam carrier 22 is supported by the camshaft 12 in a form that the cam carrier 22 is slidable in the axial direction of the camshaft 12 and that the movement of the cam carrier 22 in the rotational direction of the camshaft 12 is restricted. As shown in FIG. 1, two pairs of intake cams 14 and 16 for driving two intake valves in the same cylinder are formed on the cam carrier 22. Also, the intake cams 14 and 16 of each pair are disposed adjacently to each other. Moreover, a cam groove 26 is formed on the outer peripheral surface of each cam carrier 22 that corresponds to a part of the outer peripheral surface of the camshaft 12.

(Cam Groove)

Figures 2A, 2B:
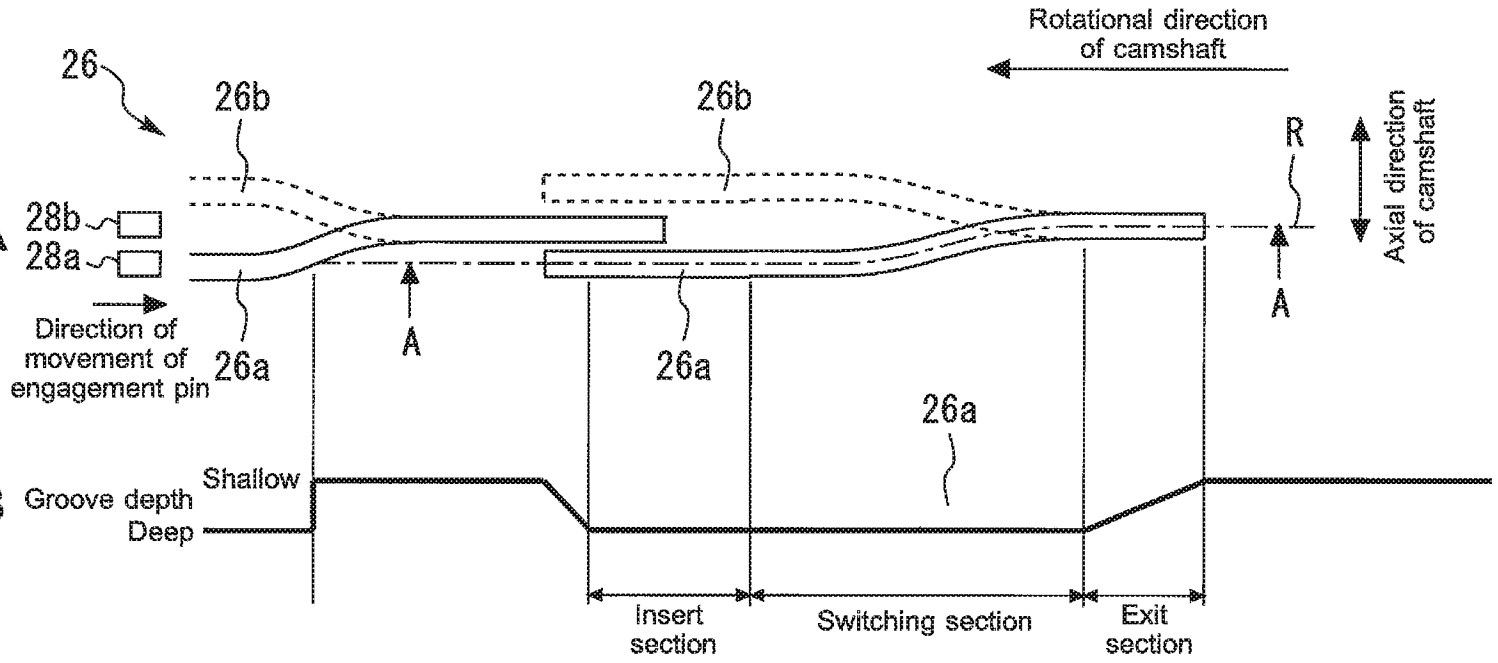
FIGS. 2A and 2B are views showing a configuration of a cam groove shown in FIG. 1.

FIGS. 2A and 2B are views for describing a concrete configuration of the cam groove 26 shown in FIG. 1. More specifically, FIG. 2A is a view obtained by developing, on a plane, the cam groove 26 formed in the outer peripheral surface of the cam carrier 22. The cam groove 26 is provided as a pair of cam grooves 26*a* and 26*b* corresponding to a pair of engagement pins 28*a* and 28*b* described in detail later. It should be noted that, since the movement of the engagement pin 28 with respect to the cam groove 26 is based on the rotation of the camshaft 12, the direction of the movement is a direction opposite to the rotational direction of the camshaft 12 as shown in FIG. 2A.

Each pair of cam grooves 26*a* and 26*b* is formed so as to extend in the circumferential direction of the camshaft 12, and paths of the cam grooves 26*a* and 26*b* join to each other as shown in FIG. 2A. In more detail, the cam grooves 26*a* and 26*b* are respectively provided corresponding to the engagement pins 28*a* and 28*b*, and each of them includes an "insert section" and a "switching section".

Each of the insert sections is formed so as to extend in a "perpendicular direction" that is perpendicular to the axial direction of the camshaft 12 and such that one of the engagement pins 28*a* and 28*b* is inserted thereinto. The switching section is formed so as to be continuous with one end of the insert section at a location on the rear side with respect to the insert section in the rotational direction of the camshaft 12 and to extend in a direction that is inclined with respect to the perpendicular section. The switching section is provided so as to fall within a section (i.e., a base circle section) in which neither of the intake cams 14 and 16 provided at the cam carrier 22 on which the cam groove 26 having this switching section is formed is in a position to lift the respective intake valves. The switching section of the cam groove 26*a* and the switching section of the cam groove 26*b* are oppositely inclined to each other with respect to the axial direction of the camshaft 12. Moreover, a shared portion of the cam grooves 26*a* and 26*b* in which the paths thereof join corresponds to an "exit direction" in which the engagement pin 28 exits from the cam groove 26.

In FIG. 2A, a movement route R of the engagement pin 28 in association with the rotation of the camshaft 12 is shown. FIG. 2B is a longitudinal sectional view of the cam groove 26*a* that is obtained by cutting the cam carrier 22 along an A-A line in FIG. 2A (that is, along the movement route R of the engagement pin 28). In addition, the longitudinal sectional view of the cam groove 26*b* is also similar to this. As shown in FIG. 2B, the groove depths of the insert section and the switching section are constant, as an example. On the other hand, the groove depth of the exit section is not constant and becomes smaller gradually when the position of the groove comes closer to an end of the exit section on the rear side in the rotational direction of the camshaft 12.

It should be noted that, in the example shown in FIGS. 2A and 2B, each of the cam grooves 26*a* includes an "inclined section" in which the groove depth gradually changes. The inclined section is located on the forward side with respect to the insert section in the rotational direction of the camshaft 12. However, this kind of inclined section may not be always provided to the cam groove according to the present disclosure, and the end of the insert section on the side opposite to the switching section may be continuous with the outer periphery surface of the cam carrier 22 in a step-wise fashion.

Figure 3:
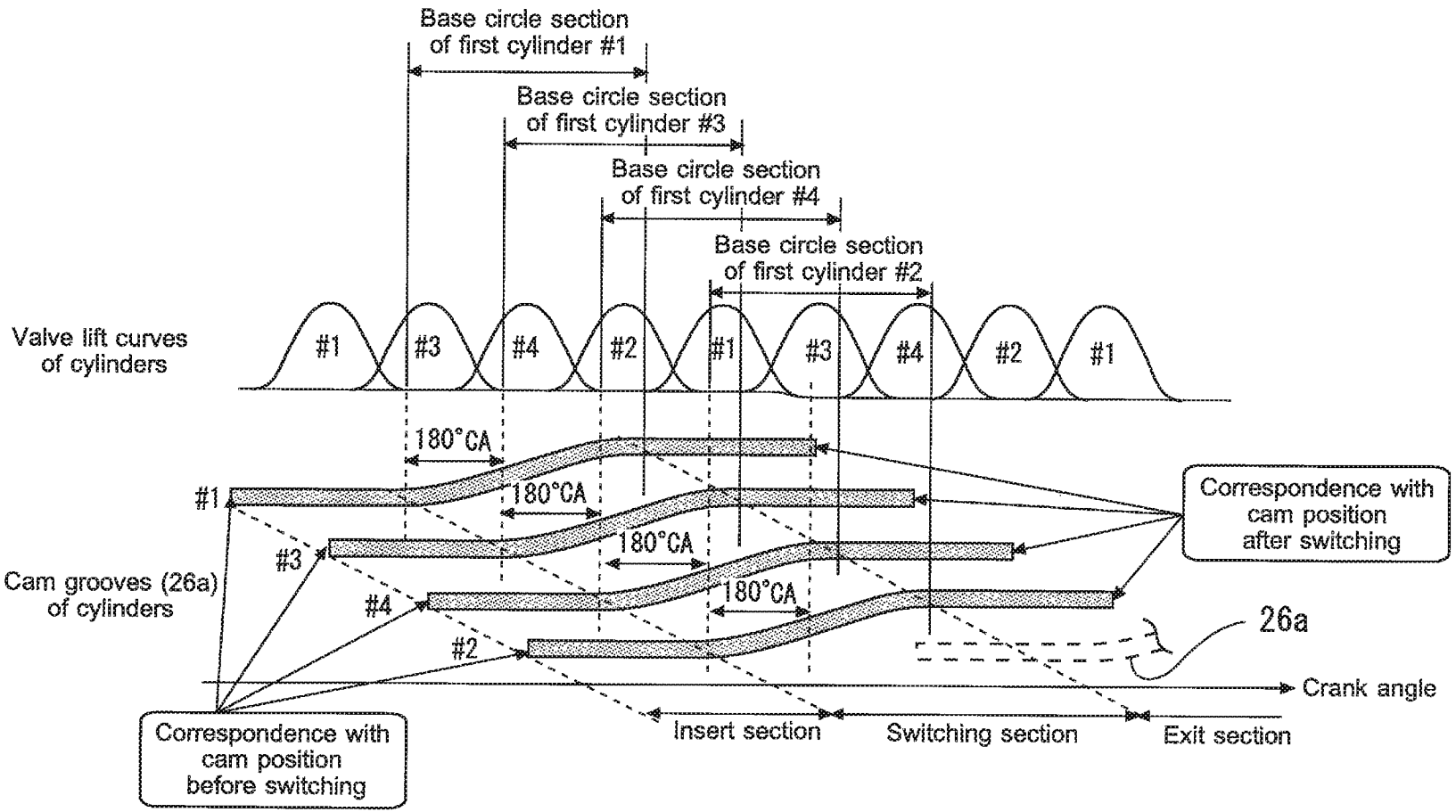
FIG. 3 is a diagram that illustrates a relationship between the arrangement of the cam grooves of the individual cylinders and the valve lift curves of the individual cylinders.

FIG. 3 is a diagram that illustrates a relationship between the arrangement of the cam grooves of the individual cylinders and the valve lift curves of the individual cylinders. It should be noted that, in FIG. 3, the cam grooves 26*a* of the pairs of cam grooves 26*a* and 26*b* are illustrated in a representative manner.

According to the internal combustion engine 1 that is an in-line four-cylinder engine as an example, as shown in FIG. 3, the cam grooves 26 of the individual cylinders are formed with a phase difference of 180 degrees in crank angle (i.e., 90 degrees in cam angle) between the adjacent cylinders in order according to the firing order described above. The switching section of each cylinder is provided so as to fall within the base circle section of the intake valve in each cylinder. Furthermore, the cam groove 26*a* shown by the broken line in FIG. 3 represents a phase (i.e., crank angle position) of the cam groove 26*a* corresponding to the combustion cycle next to the combustion cycle corresponding to the phase of the cam groove 26*a* shown by the solid line, by taking the second cylinder #2 as an example. In this way, the insert section of the engagement pin 28 with respect to the same cam groove 26*a* arrives for every one combustion cycle.

(Actuator)

The actuator 24 is fixed to a stationary member 27, such as a cylinder head, at a location that is opposed to the cam groove 26. The actuator 24 is equipped with the engagement pins 28*a* and 28*b* that are capable of engaging with the cam grooves 26*a* and 26*b*, respectively. The actuator 24 is configured in such a way as to be capable of selectively protruding one of the engagement pins 28*a* and 28*b* toward the camshaft 12 (more specifically, toward the cam groove 26).

It should be noted that, as a premise of the cam switching operation, the following positional relation is met among the pair of intake cams 14 and 16, the pair of cam grooves 26*a* and 26*b*, and the pair of the engagement pins 28*a* and 28*b* as shown in FIG. 1. That is, a distance between a groove center line of the insert section of the cam groove 26*a* and a groove center line of the (shared) exit section of the cam grooves 26*a* and 26*b* is a distance D1 and is the same as a distance between a groove center line of the insert section of the cam groove 26*b* and the groove center line of the exit section. Moreover, this distance D1 is the same as each of a distance D2 between center lines of the pair of intake cams 14 and 16 and a distance D3 between center lines of the pair of engagement pins 28*a* and 28*b*.

Figure 4:
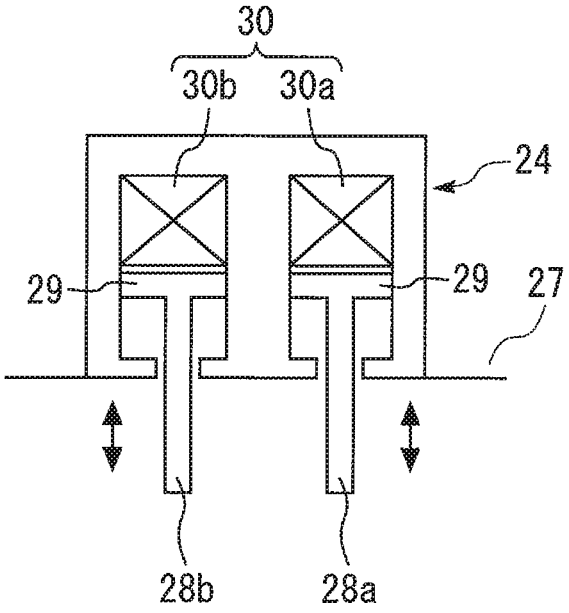
FIG. 4 is a diagram that schematically illustrates an example of a configuration of an actuator shown in FIG. 1.

FIG. 4 is a diagram that schematically describes an example of a configuration of the actuator 24 shown in FIG. 1. The actuator 24 according to the present embodiment is of an electromagnetic solenoid type, as an example. As shown in FIG. 4, the actuator 24 is equipped with an electromagnet (a pair of electromagnets 30*a* and 30*b*) for the pair of the engagement pins 28*a* and 28*b*. The engagement pin 28 is built into the actuator 24. The engagement pin 28 has a plate-like portion 29 that is located at an end of the engagement pin 28 on the side opposed to the electromagnet 30 and that is formed by a magnetic material. Control of energization to the actuator 24 (the electromagnet 30) is performed on the basis of a command from an electronic control unit (ECU) described later. The actuator 24 is configured such that, when the energization to the electromagnet 30 is performed, the engagement pin 28 reacts against the electromagnet 30 and is protruded toward the camshaft 12 (the cam carrier 22). Thus, with the energization to the actuator 24 being performed at an appropriate timing, the engagement pin 28 can be engaged with the cam groove 26.

When the engagement pin 28 that is in engagement with the cam groove 26 enters into the exit section as a result of the rotation of the camshaft 12, the engagement pin 28 is displaced so as to be pushed back to the side of the electromagnet 30 by the effect of the bottom surface in which the groove depth becomes gradually smaller. If the engagement pin 28 is pushed back in this way, an induced electromotive force is generated at the electromagnet 30*b*. When this induced electromotive force is detected, the energization to the actuator 24 (the electromagnet 30) is stopped. As a result, the engagement pin 28 is attracted to the electromagnet 30, and the exit of the engagement pin 28 from the cam groove 26 is completed.

1-4. Control System

The system according to the present embodiment is provided with the ECU 40 as a control device. Various sensors installed in the internal combustion engine 1 and the vehicle on which the internal combustion engine is mounted and various actuators for controlling the operation of the internal combustion engine 1 are electrically connected to the ECU 40.

The various sensors described above include a crank angle sensor 42, an oil temperature sensor 44, an air flow sensor 46, an accelerator position sensor 48, a vehicle speed sensor 50 and a shift position sensor 52. The crank angle sensor 42 outputs a signal responsive to the crank angle. The ECU 40 can obtain an engine speed Ne by the use of the crank angle sensor 42. The oil temperature sensor 44 outputs a signal responsive to the temperature of an oil that lubricates each part of the internal combustion engine 1 (which includes each part (such as, the intake cams 14 and 16) of the variable valve operating device 10). The air flow sensor 46 outputs a signal responsive to the flow rate of air that is taken into the internal combustion engine 1. The accelerator position sensor 48 outputs a signal responsive to a position of an accelerator pedal of the vehicle in which the internal combustion engine 1 is mounted. The vehicle speed sensor 50 outputs a signal responsive to the speed of the vehicle. The shift position sensor 52 outputs a signal responsive to a gear position of a transmission of the vehicle.

Moreover, the various actuators described above include fuel injection valves 54 and an ignition device 56 as well as the actuators 24. Furthermore, a malfunction indicator lamp (MIL) 58 is mounted on the vehicle to notify the driver of a malfunction concerning the cam switching device 20. The MIL 58 is electrically connected to the ECU 40.

The ECU 40 includes a processor, a memory, and an input/output interface. The input/output interface receives sensor signals from the various sensors described above, and also outputs actuating signals to the various actuators described above. In the memory, various control programs and maps for controlling the various actuators are stored. The processor reads out a control program from the memory and executes the control program. As a result, the function of the "control device" according to the present embodiment is achieved.

2. Cam Switching Operation

Next, the cam switching operation with the cam switching device 20 will be described with reference to FIG. 5. Which of the intake cam (small cam) 14 and the intake cam (large cam) 16 is used as the cam that drives the intake valve is determined, for example, in accordance with the engine operating condition (mainly, the engine load and the engine speed Ne) and the magnitude of a change rate of a required torque from the driver.

2-1. Cam Switching Operation from Small Cam to Large Cam

Figure 5:
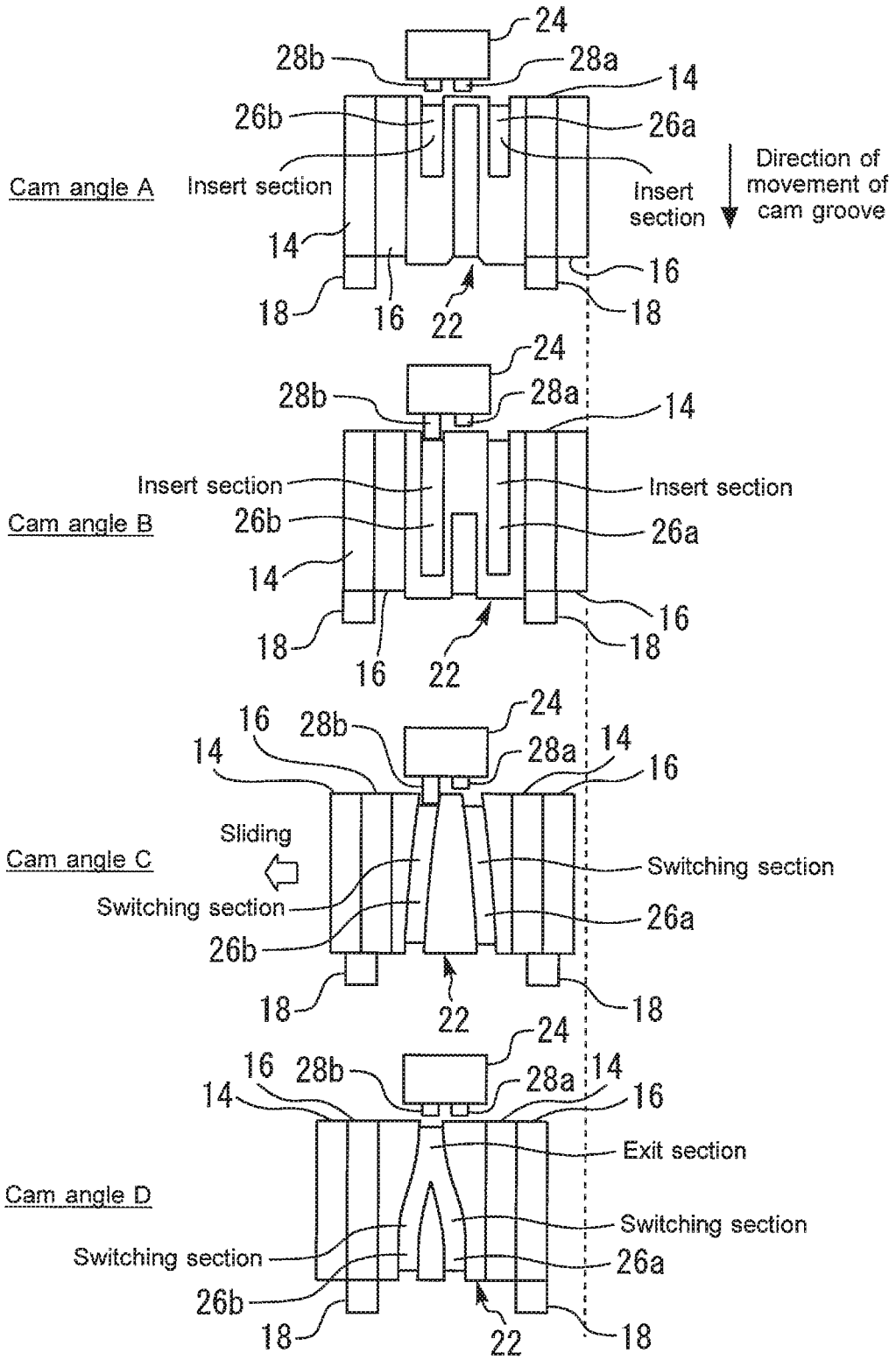
FIG. 5 is a diagram illustrating an example of a cam switching operation by a cam switching device.

FIG. 5 is a diagram for describing an example of the cam switching operation by the cam switching device 20. In more detail, the example shown in FIG. 5 corresponds to the cam switching operation performed such that the cam that drives the valve is switched from the intake cam (small cam) 14 to the intake cam (large cam) 16. In FIG. 5, the cam carrier 22 and the actuator 24 at each of cam angles A to D are represented. It should be noted that, in FIG. 5, the cam groove 26 moves from the upper side toward the lower side in FIG. 5 in association with the rotation of the camshaft 12.

In the cam angle A in FIG. 5, the cam carrier 22 is located on the camshaft 12 such that the insert section of the cam groove 26*b* is opposed to the engagement pin 28*b*. In this cam angle A, the energization to the electromagnets 30*a* and 30*b* of the actuator 24 is not performed. Also, in the cam angle A, each of the rocker arms 18 is in contact with the intake cam 14.

The cam angle B in FIG. 5 corresponds to a cam angle obtained when the camshaft 12 is rotated by 90 degrees from the cam angle A. As a result of the engagement pin 28*b* being protruded toward the camshaft 12 (the cam carrier 22) in response to execution of the energization to the actuator 24 (the electromagnet 30*b*), the engagement pin 28*b* is engaged with the cam groove 26*b* in the insert section. As shown in FIG. 5, in the cam angle B, the engagement pin 28*b* is engaged with the cam groove 26*b* in the insert section.

The cam angle C in FIG. 5 corresponds to a cam angle obtained when the camshaft 12 is rotated further by 90 degrees from the cam angle B. The engagement pin 28*b* enters into the switching section via the insert section as a result of the rotation of the camshaft 12. As shown in FIG. 5, in the cam angle C, the engagement pin 28*b* is in engagement with the cam groove 26*b* in the switching section. Since the engagement pin 28 is located in the switching section in this way, the cam carrier 22 slides to the left side in FIG. 5 from the position corresponding to the cam angle B as a result of the rotation of the camshaft 12, as can be seen by comparing the cam angle B with the cam angle C in FIG. 5.

The cam angle D in FIG. 5 corresponds to a cam angle obtained when the camshaft 12 is rotated further by 90 degrees from the cam angle C. The engagement pin 28*b* enters into the exit section after having passed through the switching section. When the engagement pin 28*b* enters into the exit section, the engagement pin 28*b* is pushed back to the side of the electromagnet 30*b* by the effect of the bottom surface of the exit section as described above. If the engagement pin 28*b* is pushed back, the ECU 40 detects the induced electromotive force of the electromagnet 30*b* to stop the energization to the electromagnet 30*b*. As a result, the engagement pin 28*b* is attracted to the electromagnet 30*b*, and the exit of the engagement pin 28*b* from the cam groove 26*b* is completed. In FIG. 5, the cam carrier 22 and the actuator 24 at the cam angle D at which the exit of the engagement pin 28*b* from the cam groove 26*b* is completed are shown.

Moreover, in the cam angle D in FIG. 5, the sliding operation of the cam carrier 22 to the left side in FIG. 5 is also completed. Thus, the cam switching operation by which the cam that gives a pressing force to the rocker arm 18 is switched to the intake cam (large cam) 16 from the intake cam (small cam) 14 is completed. According to this kind of cam switching operation, switching of the cam can be performed while the camshaft 12 rotates one revolution (that is, during one combustion cycle).

In further addition to this, when the cam switching operation to the intake cam (large cam) 16 from the intake cam (small cam) 14 is completed, the remaining engagement pin 28*a* is opposed to the insert section of the remaining cam groove 26*a* as can be seen from the illustration concerning the cam angle D in FIG. 5.

2-2. Cam Switching Operation to Small Cam from Large Cam

Since the cam switching operation to the intake cam (small cam) 14 from the intake cam (large cam) 16 is similar to the above-described cam switching operation to the intake cam (large cam) 16 from the intake cam (small cam) 14, the description therefor is herein schematically made as follows.

That is, the cam switching operation to the intake cam (small cam) 14 from the intake cam (large cam) 16 is performed when the cam carrier 22 lies at a position similar to the illustration concerning the cam angle D in FIG. 5. First, the energization to the actuator 24 (the electromagnet 30*a*) is performed such that the engagement pin 28*a* is inserted into the insert section of the cam groove 26*a*. Thereafter, during the engagement pin 28*a* passing through the switching section, the cam carrier 22 slides to the right side in FIG. 5 as a result of the rotation of the camshaft 12. Then, when the engagement pin 28*a* has passed through the switching section, the sliding operation of the cam carrier 22 is completed, and the cam that gives a pressing force to the rocker arm 18 is switched to the intake cam (small cam) 14 from the intake cam (large cam) 16. Moreover, the exit of the engagement pin 28*a* from the cam groove 26*a* is performed. It should be noted that, when the cam switching operation is completed in this way, the position of the cam carrier 22 is returned to the position at which the engagement pin 28*b* is opposed to the insert section of the cam groove 26*b*, as with the illustration concerning the cam angle A in FIG. 5.

3. Control of Cam Switching Device According to First Embodiment

3-1. Problem on Performing Cam Switching Operation for Each Cylinder

If a cam switching request that switches the individual valve-driving cams of each cylinder between the intake cam (small cam) 14 and the intake cam (large cam) 16 is issued, the cam switching operation is performed from a cylinder where a timing at which the protruding operation of the engagement pin 28 toward the insert section can be performed has come first. To be more specific, according to the internal combustion engine 1 of the multi-cylinder type that includes a plurality of (as an example, four) cylinders, the timing at which the protruding operation of the engagement pin 28 can be performed in each cylinder comes continuously for every predetermined interval (as an example, 180 degrees CA) in order according to the firing order as shown in FIG. 3. Thus, with the cam switching device 20 being controlled such that the protruding operation of the engagement pin 28 is performed in each cylinder in order according to the firing order, the profiles of the valve-driving cams in each cylinder can be sequentially switched within one combustion cycle in association with the rotation of the camshaft 12.

In performing the cam switching operation as described above, if the switching of the profiles fails for at least one cylinder due to the reasons, such as a delay of protrusion of the engagement pin 28, the profiles of the valve-driving cams become different between cylinders. As a result, since the valve operating characteristics of the intake valve become different between cylinders, there is a concern that the drivability or exhaust emission performance of the internal combustion engine 1 may be deteriorated.

A supplemental description on the reasons why the cam switching operation fails is made as follows. The cam switching device 20 is basically configured such that the failure of the cam switching operation does not occur. To be more specific, various specifications, such as the shape of each part of the cam switching device 20 including the cam groove 26, the start timing of the protruding operation of the engagement pin 28, and the value of electric current applied to the actuator 24, are determined in consideration of causes concerning the feasibility of the cam switching operation, such as variation of the electric current values for the actuator 24, the characteristics of the temperature of the actuator 24, and the characteristics of the oil. In addition, the reason why the characteristics of the oil is linked to the feasibility of the cam switching operation is that, if the viscosity of the oil is lower due to the temperature of the oil being lower, the protruding operation of the engagement pin 28 becomes easy to be hampered by the oil. However, even if this kind of basic configuration is included, there is the possibility that a failure of the cam switching operation may occur when an unintended malfunction, such as a large decrease of the electric current value for the actuator 24 due to some cause during operation of the internal combustion engine 1 or an occurrence of the aging of each part of the cam switching device 20, has occurred.

3-2. Outline of Control of Cam Switching Device According to First Embodiment

In view of the problem described above, in the present embodiment, the following control is performed in order to decrease the probability that the profiles of the valve-driving cams become different between cylinders even if the switching of the profiles fails at a part of the cylinders when the cam switching operation that selectively switches the profiles of the valve-driving cams of a plurality of cylinders (in the present embodiment, all the cylinders of the internal combustion engine 1) is performed. For convenience of description, when a cam switching request is made, the profile (which is shared in all the cylinders) of the valve-driving cams used before the switching is referred to as a "first profile", and the profile (which is shared in all the cylinders) of the valve-driving cams used after the switching is referred to as a "second profile".

More specifically, in the present embodiment, if, although the ECU 40 has caused the cam switching device 20 to perform a cam switching operation for switching the profile of each of the valve-driving cams of all the cylinders from the first profile to the second profile (referred to as a "first cam switching operation" for convenience), the profiles of the valve-driving cams of all the cylinders do not coincide with the second profile, the ECU 40 causes the cam switching device 20 to perform a cam switching operation for switching the profiles of the valve-driving cams to the first profile (referred to as a "second cam switching operation" for convenience). This second cam switching operation is performed not only for one or more cylinders at which the switching of the profiles to the second profile has succeeded (referred to as "one or more normal cylinders" for convenience) but also for all the cylinders.

Figure 6:
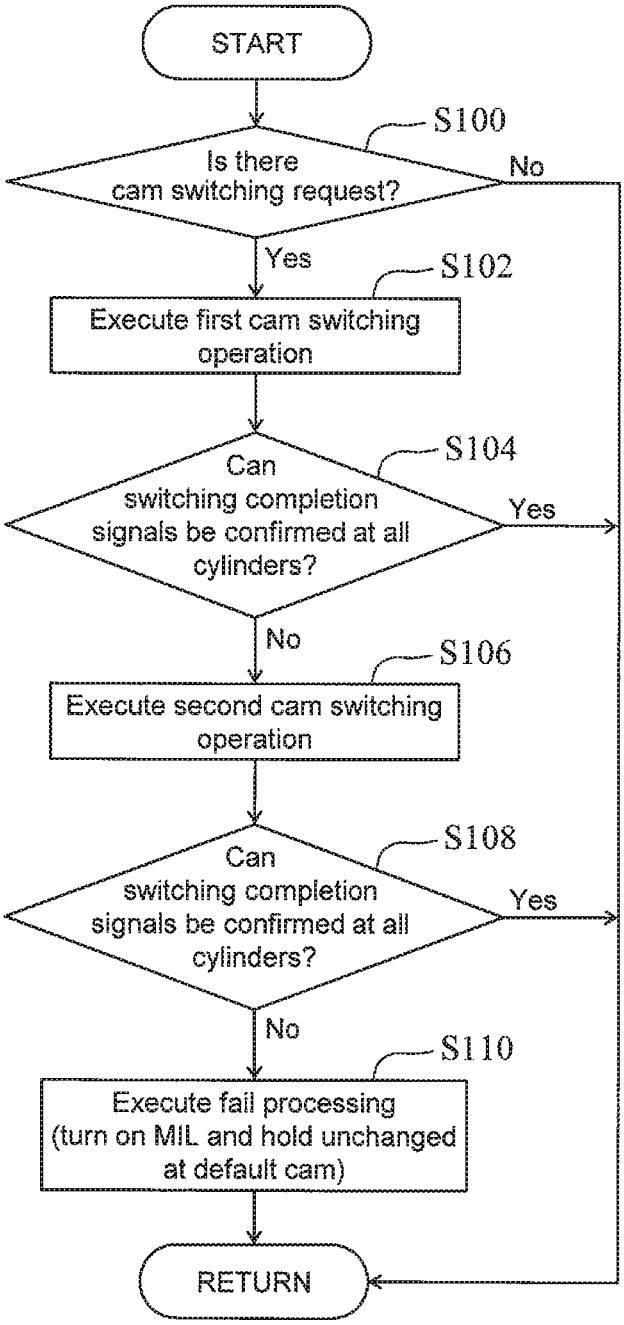
FIG. 6 is a flow chart that illustrates a routine of the processing concerning control of the cam switching device according to the first embodiment of the present disclosure.

3-3. Processing of ECU Concerning Control of Cam Switching Device According to First Embodiment FIG. 6 is a flow chart that illustrates a routine of the processing concerning the control of the cam switching device 20 according to the first embodiment of the present disclosure. It should be noted that the present routine is repeatedly executed at a predetermined control cycle during operation of the internal combustion engine 1.

In the routine shown in FIG. 6, first, the ECU 40 determines whether or not there is a cam switching request (step S100). Whether or not there is a cam switching request is determined, for example, on the basis of whether or not there is a change of a requested intake cam (i.e., small cam 14 or large cam 16) as a result of a change of the engine operating condition (mainly, engine load and engine speed Ne).

If the ECU 40 determines in step S100 that there is no cam switching request, it ends the current processing cycle of the present routine. If, on the other hand, the ECU 40 determines that there is a cam switching request, it then causes the cam switching device 20 to perform the first cam switching operation (that is, a cam switching operation for switching the profile of each of the valve-driving cams of all the cylinders from the first profile to the second profile) (step S102). It should be noted that, in the example of the cam switching device 20 according to the present embodiment, if the profile of the small cam 14 corresponds to the first profile, the profile of the large cam 16 corresponds to the second profile, and, if, on the other hand, the profile of the large cam 16 corresponds to the first profile, the profile of the small cam 14 corresponds to the second profile.

An increase of the engine speed Ne corresponds to an example of the change of the engine operating condition that becomes a cause for the cam switching request determined in step S100 being made. Thus, when the engine speed Ne is increasing (that is, the time of the acceleration) corresponds to an example of the times of the first cam switching operation by the processing of the step S102 being performed.

Next, the ECU 40 determines whether or not switching completion signals of all the cylinders can be confirmed (step S104). According to the configuration of the cam switching device 20, as already described, the engagement pin 28 that has been inserted into the cam groove 26 enters the exit section after having passed through the switching section. Moreover, when the engagement pin 28 is thereafter pushed back to the side of the electromagnet 30 by the effect of the bottom surface of the exit section (that is, when the cam switching operation has been normally completed), an induced electromotive force is generated at the electromagnet 30. Thus, whether or not the cam switching operation has been normally completed can be determined, as an example, on the basis of whether or not the induced electromotive force is actually detected at a timing at which this kind of induced electromotive force should be generated (that is, a timing at which the engagement pin 28 has passed through the exit section). Therefore, a signal responsive to this kind of induced electromotive force corresponds to an example of the switching completion signal described above. In addition, whether or not the cam switching operation has been normally completed can also be determined, for example, by detecting the presence or absence of the displacement of the cam carrier 22 (intake cams 14 and 16) by the use of a gap sensor.

If the switching completion signals of all the cylinders can be confirmed in step S104, that is, if it can be judged that the profiles of the valve-driving cams of all the cylinders coincide with the second profile as a result of the first cam switching operation being normally performed, the ECU 40 ends the current processing cycle of the present routine.

If, on the other hand, the switching completion signals of all the cylinders cannot be confirmed in step S104, that is, if it can be judged that, although the cam switching device 20 has been caused to perform the first cam switching operation, the profiles of the valve-driving cams of all the cylinders do not coincide with the second profile, the ECU 40 proceeds to step S106.

In step S106, the ECU40 causes the cam switching device 20 to execute the second cam switching operation. In more detail, in step S106, the ECU 40 executes, as an example of the second cam switching operation, the cam switching operation for switching the profiles of the valve-driving cams to the first profile not only for one or more normal cylinders at which the switching of the profile to the second profile has succeeded but also for all the cylinders. In further addition to this, whether or not there is a switching completion signal determined in step S104 is grasped sequentially in order of cylinders according to the firing order, in association with the rotation of camshaft 12. Accordingly, the ECU 40 may execute the determination of step S104 after the ECU 40 has grasped whether or not there are the switching completion signals of all the cylinders. Alternatively, the ECU 40 may determine that the determination result of step S104 is negative at a timing at which non-occurrence of the switching completion signal is detected at a cylinder before the ECU 40 has grasped whether or not there are the switching completion signals of all the cylinders, and may proceed to step S106 immediately.

Next, the ECU 40 determines whether or not the switching completion signals of all the cylinders can be confirmed by the processing similar to that of step S104 (step S108). As a result, if the ECU 40 can confirm, in step S108, the presence of the switching completion signals of all the cylinders, that is, if it can be judged that the profiles of the valve-driving cams of all the cylinders coincide with the first profile as a result of the second cam switching operation being normally performed, the ECU 40 ends the current processing cycle of the present routine.

If, on the other hand, the ECU 40 cannot confirm, in step S108, the presence of the switching completion signals of all the cylinders, that is, if it can be judged that, although the cam switching device 20 has been caused to perform the second cam switching operation, the profiles of the valve-driving cams of all the cylinders do not coincide with the first profile, the ECU 40 proceeds to step S110.

In step S110, the ECU 40 executes a predetermined fail processing. In detail, the ECU 40 judges that there is the possibility that a malfunction may occur at the cam switching device 20 due to the fact that the profiles of the valve-driving cams of all the cylinders cannot be returned to the first profile, and executes the processing to turn on the MIL 58 to notify the driver of this possibility of the malfunction. In addition, in step S110, the ECU 40 gives, as needed, the cam switching device 20 a command to hold the valve-driving cams of all the cylinders unchanged at a default cam. As an example, the default cam mentioned here refers to the intake cam 14 or 16 to be used at the time of an idling operation of the internal combustion engine 1.

To be more specific, if the second cam switching operation by the processing of step S106 prior to the processing of step S110 corresponds to an operation to switch the valve-driving cams to the default cam, the ECU 40 does not execute a further cam switching operation in step S110. If, on the other hand, the second cam switching operation by the processing of step S106 prior to the processing of step S110 corresponds to an operation opposite to the operation to switch the valve-driving cams to the default cam, the ECU 40 gives the cam switching device 20 a command for switching the valve-driving cams of all the cylinders to the default cam in step S110, and does not perform a further cam switching operation after giving this command.

4. Advantageous Effects of Control of Cam Switching Device According to First Embodiment According to the processing of the routine shown in FIG. 6 described so far, if, although the first cam switching operation has been performed to switch the profile of each of the valve-driving cams of all the cylinders from the first profile to the second profile (i.e., the switching from the first profile to the second profile), the profiles of the valve-driving cams of all the cylinders do not coincide with the second profile, the second cam switching operation for switching the profiles of the valve-driving cams to the first profile is performed for all the cylinders including one or more normal cylinders at which the switching of the profiles to the second profile has succeeded.

It is conceivable that, if the switching of the profiles of the valve-driving cams to the second cam profile by the first cam switching operation is retried for one or more cylinders at which a failure of the switching to the second profile has occurred, the switching to the second profile may fail again due to the effect of a malfunction that causes the failure mentioned above. Thus, it can be said that the probability that the second cam switching operation for returning the profiles of the valve-driving cams to the first profile succeeds at one or more cylinders at which the switching to the second profile by the first cam switching operation can be normally performed is higher than the probability that the first cam switching operation for retrying the switching of the profiles of the valve-driving cams to the second profile succeeds at one or more cylinders at which the switching to the second profile by the first cam switching operation has failed. According to the processing of the routine described above, the probability that the profiles of the valve-driving cams become different between cylinders can therefore be decreased even if the switching of the profiles has failed at a part of a plurality of cylinders (in the present embodiment, all the cylinders) when the cam switching operation for switching the profiles of the valve-driving cams of the plurality of cylinders is performed.

(Advantageous Effects of Performing Second Cam Switching Operation for All Cylinders)

Moreover, according to the processing of the routine described above, if, although the first cam switching operation has been performed, the profiles of the valve-driving cams of all the cylinders do not coincide with the second profile, the second cam switching operation is performed not only for one or more normal cylinders at which the switching of the profiles to the second profile has succeeded but also for all the cylinders. Performing the second cam switching operation for all the cylinders in this way has the following advantageous effects. That is, when a malfunction concerning, for example, detection of the switching completion signal by the processing of step S104 has occurred, an erroneous decision that, although the first cam switching operation has actually succeeded, a failure of the first cam switching operation has occurred may be made at a cylinder. However, even if this kind of erroneous decision is made, the second cam switching operation is performed for all the cylinders. Because of this, returning the profiles of the valve-driving cams to the second profile can therefore be retried at the cylinder at which the erroneous decision has been made as described above. In addition, this is effective to decrease the probability that the profiles of the valve-driving cams become different between cylinders.

(Advantageous Effects of Performing Second Cam Switching Operation During Increase of Engine Speed Ne (at Time of Acceleration)

Furthermore, as described above, according to the processing of the routine shown in FIG. 6, when the engine speed Ne is increasing corresponds to an example of the time of the second cam switching operation being performed when, although the first cam switching operation has been performed, the profiles of the valve-driving cams of all the cylinders do not coincide with the second profile.

According to the cam switching device 20 by which the profiles of the valve-driving cams are switched by the use of the rotation of the camshaft 12, the switching of the profiles is required to be performed during the base circle section as described above, and the crank angle width where the insert section (see FIGS. 2 and 3) in which the engagement pin 28 can be inserted into the cam groove 26 can be provided is limited. Also, the higher the rotational speed of the camshaft 12 (that is, the engine speed Ne) is, the shorter the time in which insertion of the engagement pin 28 into the cam groove 26 can be performed becomes. Moreover, it is required to complete, within this kind of limited time, issuance of a command for the protruding operation of the engagement pin 28, execution of the protruding operation and seating of the engagement pin 28 in the insert section of the cam groove 26. Thus, a switching upper limit value of engine speeds Ne at which the profiles can be surely switched is present. Furthermore, as already described, according to the internal combustion engine 1 of the multi-cylinder type, the timing at which the protruding operation of the engagement pin 28 can be performed in each cylinder continuously arrives for every predetermined interval in order according to the firing order as shown in FIG. 3, and one combustion cycle (that is, two revolutions of the crankshaft) is therefore required in order to switch the profiles of the valve-driving cams of all the cylinders. Because of this, when the engine speed Ne is increasing, it is required to complete the switching before the engine speed Ne arrives at the switching upper limit value Neth while considering a point that one combustion cycle is required for the switching of the profiles of the valve-driving cams of all the cylinders. Thus, when this kind of point is taken into consideration, the conditions required to be able to surely complete the switching for all the cylinders become more severe.

To address the above-described further problem in terms of the engine speed Ne, according to the processing of the routine described above, if, although the first cam switching operation has been performed, the profiles of the valve-driving cams of all the cylinders do not coincide with the second profile, the second cam switching operation is performed. Contrary to this kind of processing, if the profiles of the valve-driving cams of all the cylinders do not coincide with the second profile during an increase of the engine speed Ne, it is conceivable to retry that the profiles of the valve-driving cams of all the cylinders are caused to coincide with the second profile by performing the first cam switching operation again. However, if this kind of retry further fails during an increase of the engine speed Ne in spite of the switching upper limit value Neth being present, time for returning the profiles of the valve-driving cams of all the cylinders to the first profile thereafter cannot be found. In contrast to this, according to the processing of the routine described above, even if the cam switching request is made during an increase of the engine speed Ne where time that can be used for the switching of the profiles is not enough due to the switching upper limit value Neth being present, the probability that the profiles of the valve-driving cams become different between cylinders due to the failure of the switching of the profiles at a part of the cylinders can be decreased.

Second Embodiment

Next, a second embodiment according to the present disclosure will be described with reference to FIG. 7.

1. Configuration of System and Cam Switching Operation According to Second Embodiment In the following description, it is assumed that the configuration shown in FIG. 1 is used as an example of the configuration of a system according to the second embodiment. In addition, the cam switching operation according to the present embodiment is similar to the cam switching operation according to the first embodiment except for the points concerning control of the cam switching device 20 described below.

2. Control of Cam Switching Device According to Second Embodiment

2-1. Outline of Control of Cam Switching Device According to Second Embodiment According to the first embodiment described above, if, although the first cam switching operation has been performed, the profiles of the valve-driving cams of all the cylinders do not coincide with the second profile, the second cam switching operation is immediately performed. In contrast to this, in the present embodiment, if, although the first cam switching operation has been performed, the profiles of the valve-driving cams of all the cylinders do not coincide with the second profile during an increase of the engine speed Ne, the ECU 40 determines whether or not a "time margin for retry" is left until the engine speed Ne reaches the switching upper limit value Neth (which has already been described in the first embodiment). The time margin for retry is the sum of a time T1 required to retry the first cam switching operation and a time T2 required to perform the second cam switching operation on the condition that the retry has failed. Also, if the time margin for retry is left, the ECU 40 causes the cam switching device 20 to retry the first cam switching operation, and, if, on the other hand, the time margin for retry is not left, the ECU 40 causes the cam switching device 20 to perform the second cam switching operation.

2-2. Processing of ECU Concerning Control of Cam Switching Device According to Second Embodiment FIG. 7 is a flow chart that illustrates a routine of the processing concerning the control of the cam switching device 20 according to the second embodiment of the present disclosure. The processing of steps S100 to S110 in the routine shown in FIG. 7 is as already described in the first embodiment.

Figure 7:
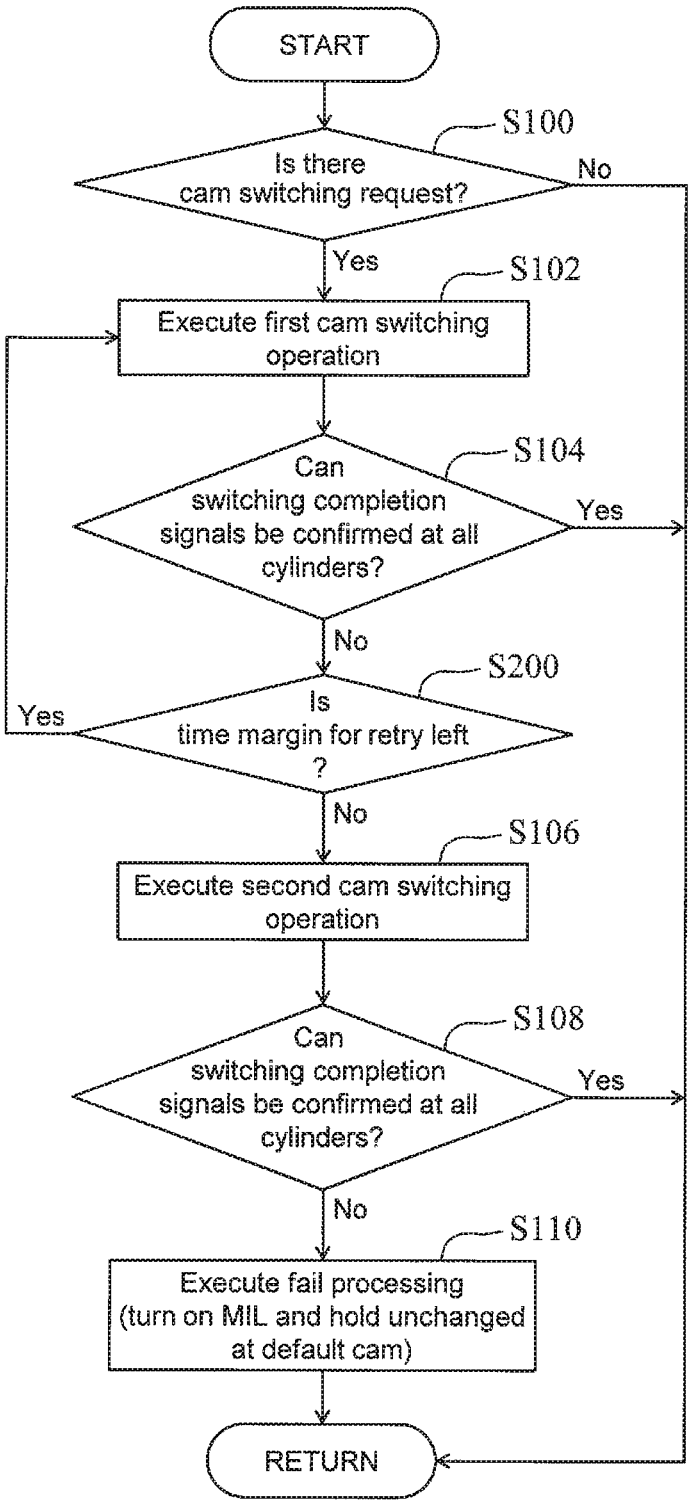
FIG. 7 is a flow chart that illustrates a routine of the processing concerning control of the cam switching device according to a second embodiment of the present disclosure.

In the routine shown in FIG. 7, if in step S104 the ECU 40 cannot confirm the switching completion signals of all the cylinders, that is, if it can be judged that, although the ECU 40 has caused the cam switching device 20 to perform the first cam switching operation, the profiles of the valve-driving cams of all the cylinders do not coincide with the second profile, the ECU 40 proceeds to step S200.

In step S200, the ECU 40 determines whether or not the time margin for retry that is the sum of the time T1 required to retry the first cam switching operation and the time T2 required to perform the second cam switching operation on the condition that the retry has failed is left until the engine speed Ne reaches the switching upper limit value Neth. This kind of determination can be performed, for example, on the basis of the current value of the engine speed Ne and a prediction result of the rate of increase of the engine speed Ne. The reason why the prediction result of the rate of increase of the engine speed Ne is used for this determination is as follows. That is, there is the possibility that, if the rate of increase of the engine speed Ne is high, the engine speed Ne may exceed the switching upper limit value Neth during an extremely short time. Thus, the rate of increase of the engine speed Ne is also used in order to more accurately determine whether or not the engine speed exceeds the switching upper limit value Neth due to the reason that the time margin for retry described above cannot be ensured.

To be more specific, if, for example, a relationship is predetermined between the engine speed NE, the position and rate of depression of the accelerator pedal and the gear position of the vehicle, and the rate of increase of the engine speed Ne, this rate of increase can be calculated, during operation of the internal combustion engine 1, as a value depending on the current value of the engine speed Ne, the position and rate of depression of the accelerator pedal that can be obtained by the use of the accelerator position sensor 48, and the gear position of the vehicle based on the shift position sensor 52. Also, if the rate of increase is obtained, the time required until the engine speed Ne reaches the switching upper limit value Neth can be calculated on the basis of the current value of the engine speed Ne and the rate of increase thereof. Moreover, if, for example, a relationship is predetermined between these times T1 and T2, and one or more parameters, such as the engine speed NE, each of the times T1 and T2 of which the time margin for retry is composed can be calculated, during operation of the internal combustion engine 1, as a value depending on the one or more parameters, such as the engine speed Ne. Furthermore, the above-described prediction result of the rate of increase of the engine speed Ne may be obtained by further taking into consideration the following viewpoints. That is, there is the possibility that, if, for example, the gear position of the transmission is erroneously changed by the driver to a gear position that is lower than the current gear position, the engine speed Ne may increase rapidly. A set of gear positions before and after a switching that may occur due to a mistake of operation of the transmission, the vehicle speed, and the depression amount of the accelerator pedal can be taken as an example of one or more parameters that affect the behavior of this kind of rapid increase of the engine speed Ne. Accordingly, for example, a map that defines a relationship between the maximum rate of increase of the engine speed Ne that may be assumed due to this kind of mistake of operation of the transmission and the one or more parameters described above may be stored in the ECU 40. On that basis, the determination of step S200 may alternatively be performed in consideration of a prediction value of the maximum rate of increase obtained from this kind of map.

If the ECU 40 determines in step S200 that the time margin for retry is left, it then proceeds to step S202 to retry the first cam switching operation. If, on the other hand, the ECU 40 determines in step S200 that the time margin for retry is not left, it then proceeds to step S106 to execute the second cam switching operation.

3. Advantageous Effects of Control of Cam Switching Device According to Second Embodiment According to the processing of the routine shown in FIG. 7 described so far, when the cam switching request is made during an increase of the engine speed Ne (during acceleration), the ECU 40 tries the switching to the profile according to the cam switching request as possible. Moreover, according to the processing, even if a failure of the switching of the profile has occurred at a part of the cylinders as a result of the try, the probability that the profiles of the valve-driving cams become different between cylinders can be decreased by the processing that is common to that according to the first embodiment.

Figure 8:
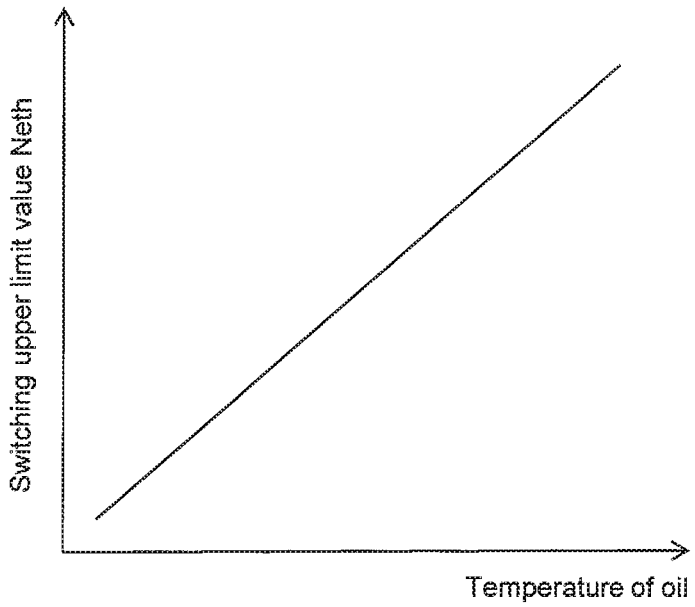
FIG. 8 is a graph that illustrates an example of setting of a switching upper limit value Neth of engine speed Ne based on the temperature of an oil.

5. Example of Setting of Switching Upper Limit Value Neth of Engine Speed Ne Based on Temperature of Oil FIG. 8 is a graph that illustrates an example of setting of the switching upper limit value Neth of the engine speed Ne based on the temperature of the oil. As already described, if the viscosity of the oil is low due to the temperature of the oil that lubricates each part of the internal combustion engine 1 (including each part of the variable valve operating device 10, such as the intake cams 14 and 16) being low, the protruding operation of the engagement pin 28 becomes easy to be hampered by the oil. Accordingly, when the determination of step S200 described above is made, the temperature of the oil may be obtained by, for example, the use of the oil temperature sensor 44, and then, the switching upper limit value Neth that is determined so as to be lower when the temperature of the oil is lower as shown in FIG. 8 may alternatively be used. According to this kind of control example, the time margin for retry can be evaluated more accurately in the determination of step S200 while also taking into consideration the effects of the temperature (viscosity) of the oil to the protruding operation of the engagement pin 28.

Third Embodiment

Next, a third embodiment according to the present disclosure will be described with reference to FIG. 9.

1. Configuration of System and Cam Switching Operation According to Third Embodiment In the following description, it is assumed that the configuration shown in FIG. 1 is used as an example of the configuration of a system according to the third embodiment. In addition, the cam switching operation according to the present embodiment is similar to the cam switching operation according to the first embodiment except for the points concerning control of the cam switching device 20 described below.

2. Control of Cam Switching Device According to Third Embodiment

2-1. Outline of Control of Cam Switching Device According to Third Embodiment According to the first embodiment described above, if, although the first cam switching operation has been performed, the profiles of the valve-driving cams of all the cylinders do not coincide with the second profile, the second cam switching operation is immediately performed. In contrast to this, according to the present embodiment, if a value Ncsf of a switching failure counter that indicates the number of times in which, although the first cam switching operation has been performed, the profiles of the valve-driving cams of all the cylinders do not coincide with the second profile has not yet reached a certain threshold value Ncsfguard, the ECU 40 executes the second cam switching operation repeatedly. Also, if the value Ncsf of the switching failure counter has reached the threshold value Ncsfguard, the ECU 40 executes the processing to turn on the MIL 58 instead of execution of the second cam switching operation.

2-2. Processing of ECU Concerning Control of Cam Switching Device According to Third Embodiment FIG. 9 is a flow chart that illustrates a routine of the processing concerning the control of the cam switching device 20 according to the third embodiment of the present disclosure. The processing of steps S100 to S110 in the routine shown in FIG. 9 is as already described in the first embodiment.

Figure 9:
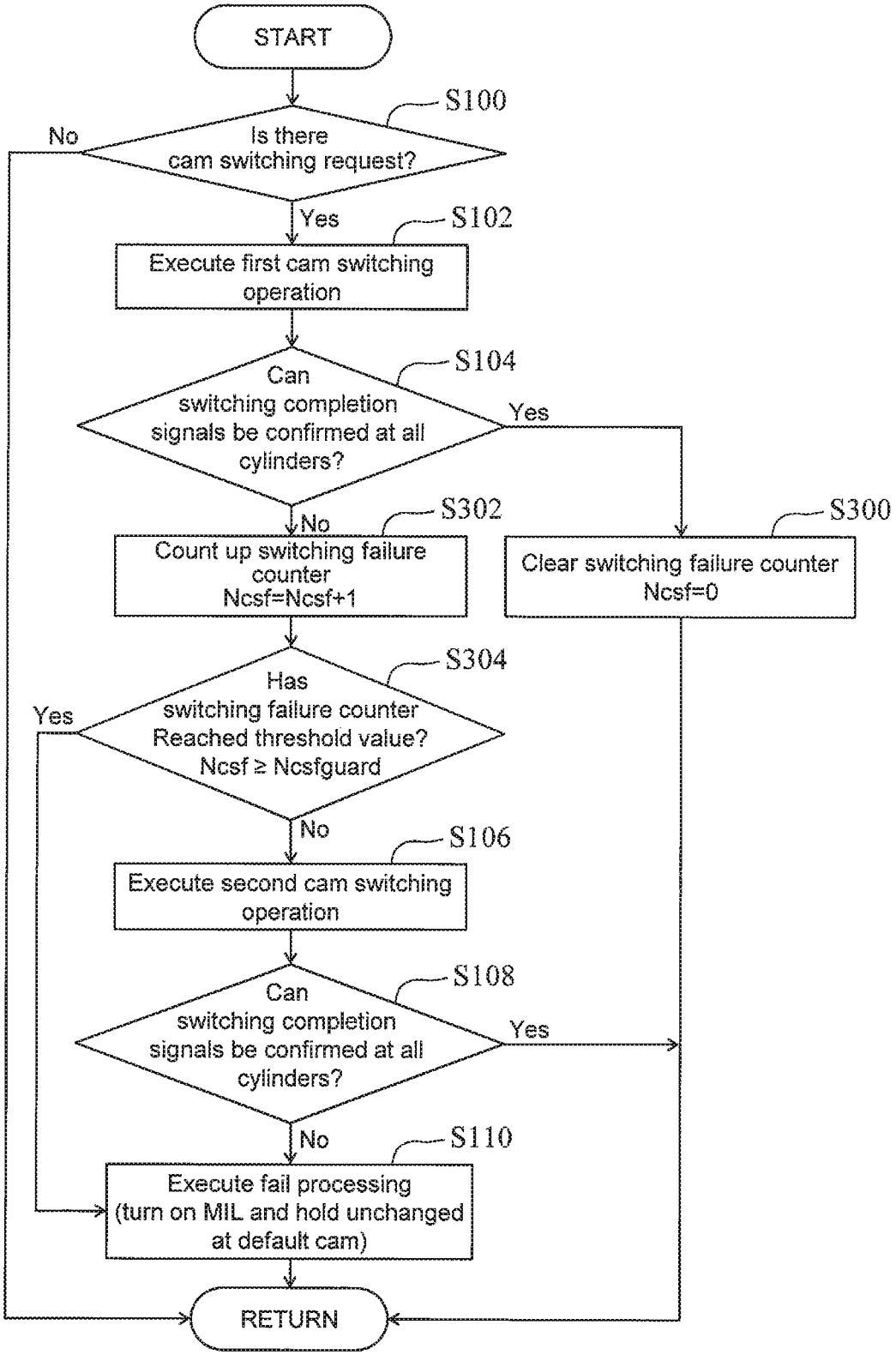
FIG. 9 is a flow chart that illustrates a routine of the processing concerning control of the cam switching device according to a third embodiment of the present disclosure.

In the routine shown in FIG. 9, if the ECU 40 can confirm, in step S104, the presence of the switching completion signals of all the cylinders, that is, if it can be judged that the profiles of the valve-driving cams of all the cylinders coincide with the second profile as a result of the first cam switching operation being normally performed, the ECU 40 then proceeds to step S300, and then clears the switching failure counter (Ncsf=0) and ends the current processing cycle of the present routine.

If, on the other hand, in step S104 the ECU 40 cannot confirm the presence of the switching completion signals of all the cylinders, that is, if it can be judged that, although the cam switching device 20 has been caused to perform the first cam switching operation, the profiles of the valve-driving cams of all the cylinders do not coincide with the second profile, the ECU 40 proceeds to step S302.

In step S302, the ECU 40 counts up the switching failure counter (Ncsf=Ncsf+1). The ECU 40 then determines whether or not the value Ncsf of the switching failure counter has reached the threshold value Ncsfguard (Ncsf≥Ncsfguard) (step S304). The threshold value Ncsfguard is an arbitrary integer value that is two or more, and is determined in advance and is stored in the ECU 40.

If the ECU 40 determines in step S302 that the value Ncsf of the switching failure counter has not yet reached the threshold value Ncsfguard, the ECU 40 proceeds to step S106 to execute the second cam switching operation. If, on the other hand, the value Ncsf of the switching failure counter has reached the threshold value Ncsfguard, the ECU 40 proceeds to step S110 without executing the second cam switching operation, and executes the fail processing (more specifically, the processing to turn on the MIL 58 and the processing to hold the valve-driving cams unchanged at the default cam).

3. Advantageous Effects of Control of Cam Switching Device According to Third Embodiment According to the processing of the routine shown in FIG. 9 described so far, if the value Ncsf of the switching failure counter that indicates the number of times in which, although the first cam switching operation has been performed, the profiles of the valve-driving cams of all the cylinders do not coincide with the second profile has reached the threshold value Ncsfguard, the MIL 58 is turned on, instead of execution of the second cam switching operation. According to this kind of processing, it can be determined more accurately that a malfunction has occurred at the cam switching device 20, and the driver can be notified of the occurrence of the malfunction.

4. Modification Example with Respect to Third Embodiment

The control of the cam switching device according to the second embodiment may be combined with the control of the cam switching device according to the third embodiment described above. More specifically, when the determination results of step S304 of the routine shown in FIG. 9 is negative, the processing of step S200 of the routine shown in FIG. 7 may be executed. Also, if the determination results of step S200 is positive, the proceeding may proceed to step S102, and, if, on the other hand, the determination results of step S200 is negative, the proceeding may proceed to step S106. Furthermore, in performing the determination of step S200, the switching upper limit value Neth may be changed depending on the temperature of the oil in accordance with the relationship shown in FIG. 8.

Other Embodiments (Cam Switching Operation on Cylinder Group Basis)

In the first to third embodiments described above, the configuration including, in each cylinder, the cam carrier 22 on which the plurality of intake cams 14 and 16 and the cam groove 26 are formed and the actuator 24 associated with the cam carrier 22 has been taken as an example. In other words, the configuration in which the cam switching operation is performed for each cylinder has been taken as an example. However, this kind of cam carrier and actuator may alternatively be installed for each of cylinder groups that are each composed of two or more cylinders. To be more specific, the alternative cam switching device is required to be configured such that the cam carrier slides in the course of an engagement pin passing through a common base circle section of cams of a plurality of cylinders included in a cylinder group that performs the switching.

(Example of Performing Second Cam Switching Operation Only for Normal Cylinder)

In the first to third embodiments described above, if, although the first cam switching operation has been performed, the profiles of the valve-driving cams of all the cylinders do not coincide with the second profile, the second cam switching operation is performed not only for one or more normal cylinders at which the switching of the profiles to the second profile has succeeded but also for all the cylinders. However, the second cam switching operation may alternatively be performed only for one or more normal cylinders. It is favorable that this kind of processing is used in an example in which a configuration that can accurately determine whether or not the first cam switching operation has succeeded is provided. This is because the processing requires a minimal command for causing the profiles of all the valve-driving cams of a "plurality of cylinders" that are subject to uniformity of the profiles to coincide with the second profile. It should be noted that a part of cylinders in an example in which the switching of cams is performed on a cylinder-to-cylinder basis, or a plurality of cylinders included in a part of cylinder groups in an example in which the switching of cams is performed on a cylinder group basis corresponds to "one or more normal cylinders that are one or more cylinders at which the switching of the profiles to the second profile has succeeded" according to the present disclosure.

Other Example of Cam Switching Device

The cam switching device 20 according to the first to third embodiments described above includes a cam groove 26 provided on the outer peripheral surface of the camshaft 12 (more specifically, the outer peripheral surface of the cam carrier 22) and the actuator 24 that includes the engagement pin 28 engageable with the cam groove 26 and that is capable of protruding the engagement pin 28 toward the camshaft 12, and is configured such that, when the engagement pin 28 is engaged with the cam groove 26, the valve-driving cam is switched between the plurality of intake cams 14 and 16 in association with the rotation of the camshaft 12. However, the cam switching device intended for the present disclosure may not be always configured as with the cam switching device 20, as far as it includes a configuration X in which the profile of a valve-driving cam that is a cam that drives a valve that opens and closes a combustion chamber in each of a plurality of cylinders is switched between the profiles of a plurality of cams on a cylinder basis or a cylinder group basis. That is, the cam switching device intended for the present disclosure may be not accompanied by a sliding operation of a cam although a cam groove provided on the outer periphery surface of a camshaft is used, as with a device disclosed in WO 2011064852 A1, for example. Furthermore, the cam switching device may alternatively be a device without using a cam groove, as far as it includes the configuration X described above.

(Interpretation of "Plurality of Cylinders" Subject to Uniformity of Profiles of Valve-Driving Cams)

In the first to third embodiments described above, all the cylinders of the internal combustion engine 1 are taken as an example of the "plurality of cylinders" mentioned here. However, the "plurality of cylinders" may not be always all the cylinders of an internal combustion engine. For example, in an internal combustion engine that is provided with a plurality of banks that are each composed of a plurality of cylinders, the "plurality of cylinders" may alternatively be the plurality of cylinders belonging to the individual banks.

Other Examples of Malfunction Indicator Device

According to the fail processing in the first to third embodiments described above, the driver is notified of a malfunction concerning the cam switching device 20 by the use of turning on the MIL 58. However, the "malfunction indicator device" according to the present disclosure may not always use the MIL 58, and may announce the malfunction by the use of a warning tone or a voice, for example.

Furthermore, the embodiments and modifications described above may be combined in other ways than those explicitly described above as required and may be modified in various ways without departing from the scope of the present disclosure.

What is claimed is:

1. A control device for an internal combustion engine, the internal combustion engine including a plurality of cylinders, a camshaft, a plurality of cams attached to the camshaft and arranged for each of the plurality of cylinders, the plurality of cams of each cylinder having profiles that are different from each other, each cam being configured to selectively drive a valve that opens and closes a combustion chamber in a corresponding cylinder of the plurality of cylinders, and a cam switching device configured to switch a valve-driving cam, which is a cam of the plurality of cams that is actively driving the valve, between the plurality of cams of each cylinder, the control device being configured to:

cause the cam switching device to perform a first cam switching operation for switching the profile of the valve-driving cam of each of the plurality of cylinders from a first profile to a second profile;

determine whether the profiles of one or more of the valve-driving cams of the plurality of cylinders do not coincide with the second profile during an increase of engine speed and after the control device has performed the first cam switching operation;

determine whether a time margin for retry remains before the engine speed reaches a switching upper limit value of engine speeds, wherein the time margin for retry is a sum of a time required to retry the first cam switching operation and a time required to perform a second cam switching operation when the retry has failed, and wherein the switching upper limit value of engine speeds is an upper limit value of engine speeds at which the cam switching device is capable of switching the profiles of the valve-driving cams; and when the time margin for retry remains before the engine speed reaches the switching upper limit value of engine speeds, cause the cam switching device to retry the first cam switching operation, and, when the time margin for retry does not remain before the engine speed reaches the switching upper limit value, cause the cam switching device to perform the second cam switching operation for switching the profile of the valve-driving cam back to the first profile for any remaining cylinders of the plurality of cylinders that do not already have a corresponding valve-driving cam with the first profile.

2. The control device according to claim 1, wherein a decrease in the switching upper limit value of the engine speeds corresponds to a decrease in a temperature of an oil that lubricates the plurality of cams arranged in each of the plurality of cylinders and an increase in the switching upper limit value of the engine speeds corresponds to an increase in the temperature of the oil.

3. The control device according to claim 1, wherein the control device is further configured to determine whether a number of times in which the profiles of the one or more of the valve-driving cams do not coincide with the second profile after the control device has performed the first cam switching operation has exceeded a threshold number of times, and when the number of times has exceeded the threshold number of times, actuate a malfunction indicator device to notify a driver of a vehicle on which the internal combustion engine is mounted of a malfunction concerning the cam switching device.

4. The control device according to claim 1, wherein the cam switching device includes:

a cam groove which is provided on an outer periphery surface of the camshaft; and an actuator which is equipped with an engagement pin configured to engage with the cam groove, the actuator being configured to protrude the engagement pin toward the camshaft, and wherein the cam switching device is configured such that, when the engagement pin is engaged with the cam groove, the valve-driving cam is switched between the plurality of cams in association with a rotation of the camshaft.

* * * * *